US005289171A

United States Patent [19]

Nire et al.

[11] Patent Number: 5,289,171

[45] Date of Patent: Feb. 22, 1994

[54] COLOR DISPLAY APPARATUS

[75] Inventors: Takashi Nire; Takehito Watanabe; Satoshi Tanda, all of Kanagawa, Japan

[73] Assignee: Kabushiki Kaisha Komatsu Seisakusho, Tokyo, Japan

[21] Appl. No.: 825,759

[22] PCT Filed: Jul. 3, 1987

[86] PCT No.: PCT/JP87/00469

§ 371 Date: Dec. 29, 1988

§ 102(e) Date: Dec. 29, 1988

[87] PCT Pub. No.: WO88/00382

PCT Pub. Date: Jan. 14, 1988

Related U.S. Application Data

[63] Continuation of Ser. No. 360,926, Dec. 29, 1988, abandoned.

[30] Foreign Application Priority Data

Jul. 3, 1986 [JP] Japan ..... 61-156896

[51] Int. Cl.[5] ..... G09G 3/30

[52] U.S. Cl. ..... 345/76; 313/503

[58] Field of Search ..... 340/701, 702, 703, 716, 340/760, 767, 781, 793, 812; 313/498, 503, 506, 509

[56] References Cited

U.S. PATENT DOCUMENTS 3,496,410 2/1970 MacIntyre .
4,379,292 4/1983 Minato et al. ..... 340/703
4,442,377 4/1984 Higton et al. ..... 313/506
4,670,355 6/1987 Matsudaira ..... 313/503
4,733,128 3/1988 Tohda et al. ..... 313/503
4,855,724 8/1989 Yang ..... 340/781

FOREIGN PATENT DOCUMENTS 63-88872 4/1988 Japan .

OTHER PUBLICATIONS

"The Institute of Electronics and Communication Engineers of Japan Technical Research Report" Yoshihiro Hamakawa et al., CPM 82-10, 1982.

*Primary Examiner*—Jeffery Brier
*Attorney, Agent, or Firm*—Diller, Ramik & Wight

[57] ABSTRACT

In the present invention, an EL element section (1) includes a plurality of arranged cells, each including a thin film EL element formed so as to emit white light, and a like number of predetermined-color filters (2) formed on the surface of the EL element section and corresponding to the cells such that each cell is caused to emit light in accordance with image information and the emitted light is output through the corresponding color filter to color display purposes. Thus, a very thin color display apparatus is provided in which contrast is good and the dependency of the luminance on the visual sensation is also good. The thin film EL element according to the present invention uses a luminous layer of zinc sulphide containing nitrogen, so that transitional luminescence occurs among a plurality of levels, and hence rays of light having various wavelengths are emitted to thereby provide white light containing three primary colors.

4 Claims, 11 Drawing Sheets

COLOR DISPLAY APPARATUS

This application is a continuation, of application Ser. No. 07/360,926, filed Dec. 29, 1988, abandoned.

TECHNICAL FIELD

The present invention relates to color display apparatus and, more particularly, to color display apparatus which include an EL panel and a color filter assembled integrally.

BACKGROUND TECHNIQUES

In a field of color display apparatus, there is an increasing tendency for small thin low-power consuming ones to be demanded, and pocket-size television sets using liquid crystal as a shutter have come as goods to public notice.

As shown in FIG. 18, a thin full-color display apparatus used in a conventional pocket-size television set includes shutter means 100 in the form of a matrix of liquid crystal cells C, a light source 101 disposed behind the shutter means, and filter means 102 disposed before the shutter means and including a repeat of a red transparent filter R, a green transparent filter G and blue transparent filter B arranged in order in correspondence to the liquid crystal cells. By controlling voltages applied to the respective liquid crystal cells in accordance with image information, quantities of light from the light source and passing through the liquid crystal cells are adjusted to thereby adjust the luminance and chromaticity of the respective pixels.

However, in such thin full-color display apparatus, there is the problem that contrast is not excellent due to the characteristic of the liquid crystal itself and that the angle of visual field is very narrow. In such apparatus, a light source as backlight is needed, so that there is the problem that the entire apparatus would be thick although the liquid crystal section itself is thin.

The thin-film EL elements each include a thin transparent luminous layer and has no granularity. Therefore, external incident light and light emitted within the luminous layer are not scattered, so that they cause no halation or oozing, the display is clear and provides high contrast. Therefore, they are highlighted as being used for a display or illumination unit.

The basic structure of a thin-film EL element includes a double dielectric structure which in turn includes on a transparent substrate a transparent electrode of tin oxide ($SnO_2$) layer, etc., a first dielectric layer of tantalum pentaoxide layer, etc., a thin luminous layer of zinc sulfide (ZnS), etc., and containing manganese (Mn), etc., a second dielectric layer of tantalum pentaoxide, etc., and a rear electrode of an aluminum (Al) layer, etc., laminated in order.

The process of luminescence is as follows. If a voltage is applied across the transparent electrode and rear electrode, the electrons trapped at the interface level are pulled out and accelerated by an electric field induced within the luminous layer so that they have energy enough to strike orbital electrons in Mn (the luminescent center) to thereby excite same.

When the excited luminescent center returns to its ground state, it emits light.

Researches in which a multicolor display panel is fabricated using thin-film EL elements have recently become popular and various researches have been made on making full color panels.

A thin-film EL element emitting white light uses a luminous layer of zinc sulfide containing praseodymium fluoride ($PrF_3$), as disclosed in Yoshihiro Hamakawa et al., *The Institute of Electronics and Communication Engineers of Japan Technical Research Report*, CPM 82-10, 1982.

As shown in FIG. 19, the thin-film EL element using the luminous layer of zinc sulfide containing praseodymium fluoride has peaks at about 500 and 650 nm in the emission spectrum. The rays of light at 500 and 650 nm are in complementary-color relationship to each other and show as if they were white light. However, the light does not contain three primary colors, so that it cannot be used for full color display.

A thin-film EL element having such structure is all transparent except for its rear electrode. Thus external incident light is reflected by the rear electrode and the reflection interferes with the light from the luminous layer so that it does not provide a satisfactory contrast ratio and thus only display devices having low display quality would be provided.

The present invention has been made in view of such situations. It is an object of the present invention to provide a thin color display apparatus which provides high contrast and a wide angle of visual field.

It is another object of the present invention to give high dielectric strength to the thin-film EL elements of a color display apparatus.

It is a further object of the present invention to improve the contrast of the thin-film EL elements.

BRIEF DESCRIPTION OF THE DRAWINGS

FIG. 1(*b*) is a plan view of the color display apparatus of FIG. 1(*a*).

FIG. 2(*b*) is a graph and illustrates the emission spectrum of the rays of light emitted from the luminous layer of FIG. 2(*a*).

FIG. 14(*b*) is a graph illustrating the relationship between oxygen content and the resistivity in the formation of a tantalum oxide film.

DISCLOSURE OF THE INVENTION

Figure 1:
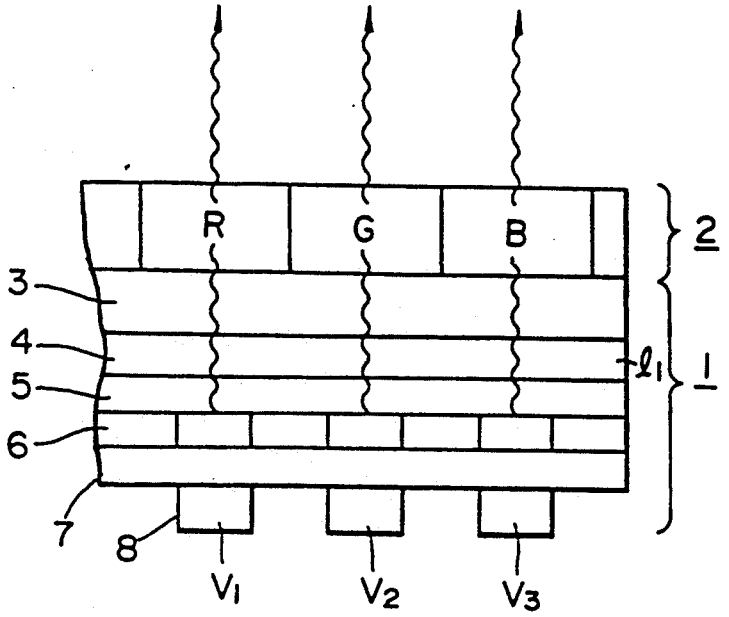
FIG. 1(*a*) is a fragmentary cross sectional view taken generally along line 1A—1A of FIG. 1(*b*) and illustrates a color display apparatus of the present invention.
Figure 1:
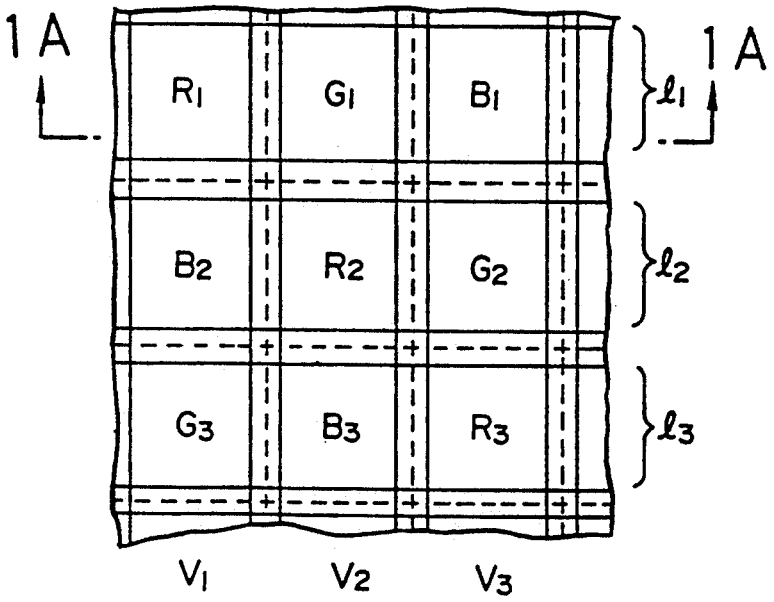

According to the present invention, a color display apparatus includes an EL panel which in turn includes an array of thin-film EL elements which emit white light, and a color filter.

For example, the apparatus includes a matrix of cells, each including an EL element, disposed on a glass baseplate and a color filter unit arranged on the side of luminous faces of the EL elements, the color filter unit including a repeat of a red, a green and a blue transparent filters disposed in order, each filter corresponding to a respective cell. By control of a voltage applied to each cell in accordance with image information, light having a desired luminance and chromaticity is emitted through the corresponding filter.

Since in this apparatus the EL elements which emit, for example, white light containing three primary colors are used as a light source and light quantity adjusting means without using any liquid crystal, contrast and the angle of visual field are increased. Furthermore, no backlight is needed and thus the apparatus can be thinned.

In the color display apparatus according to the present invention, zinc sulfide containing nitrogen is used for the luminous layers of the thin-film EL elements.

In the inventive method, the luminous layer is formed by forming a thin-film of zinc sulfide and implanting nitrogen ions in the thin-film.

By causing zinc sulfide to contain nitrogen, the electron orbit energy level in nitrogen atoms and molecules are produced in the zinc sulfide and a plurality of defective levels are generated in the zinc sulfide.

By applying an electric field across such luminous layer, electrons at the levels mentioned above are excited by striking, and transitional luminescence occurs among the levels, so that white light containing three primary colors which emit rays of light having various wavelengths is obtained.

In the present invention, the second dielectric layer of the thin-film EL elements is continuously changed from a black tantalum oxide film to a transparent tantalum oxide film.

For example, when the second dielectric layer is formed in a reactive chamber by sputtering, using as a target tantalum pentaoxide ($Ta_2O_5$) and feeding a mixed gas of argon (Ar)+oxygen ($O_2$), it is gradually changed from a black tantalum oxide ($TaO_x$ where $x < 2.5$) film to a transparent tantalum oxide ($Ta_2O_5$) film by gradually increasing the partial pressure of oxygen.

Since the stoichiometric ratio changes continuously, no dielectric breakedown occurs at the interface, and no reduction of contrast due to reflection at the interface occurs, so that thin-film EL elements are provided having high contrast and high dielectric strength.

The second dielectric layer of each thin-film EL element may be constituted by a single black layer of insulating oxide or nitride in which a proportion in composition of oxygen or nitrogen is reduced stoichiometrically.

It is considered that a stoichiometric reduction of the proportion in composition of oxygen or nitrogen will result in defects at portions lacking oxygen or nitrogen, so that light is absorbed by this defective level and hence that the dielectric layer will become black.

For example, tantalum pentaoxide ($Ta_2O_5$) is for a transparent insulating film. If the partial pressure of oxygen is reduced and the proportion in composition of oxygen is reduced in the formation of this film, the tantalum pentaoxide changes to $TaO_x$ where $x < 2.5$ and a black insulating film results. In this way, contrast is improved.

BEST MODE FOR CARRYING OUT THE INVENTION

Examples of the present invention will now be described in detail with reference to the drawings.

EXAMPLE 1

FIG. 1(*a*) and (*b*) show a thin color display apparatus as an example of the present invention. (FIG. 1(*a*) is a cross section view taken along the line 1A-1A of FIG. 1(*b*).)

The apparatus includes an EL element section 1 which in turn includes a multiplicity of thin-film EL elements or cells C arranged in a matrix and corresponding to pixels, and a color filter section 2 disposed integrally on the surface of the EL element section such that the rays of light from the respective cells are output through the color filter section.

Figure 2:
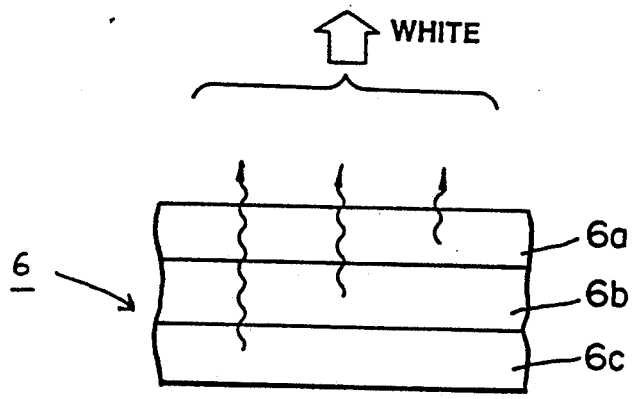
FIG. 2(*a*) is a fragmentary cross-sectional view of a luminous layer of FIG. 1(*a*), and illustrates emitted rays of light by the unnumbered headed arrows associated therewith.
Figure 2:
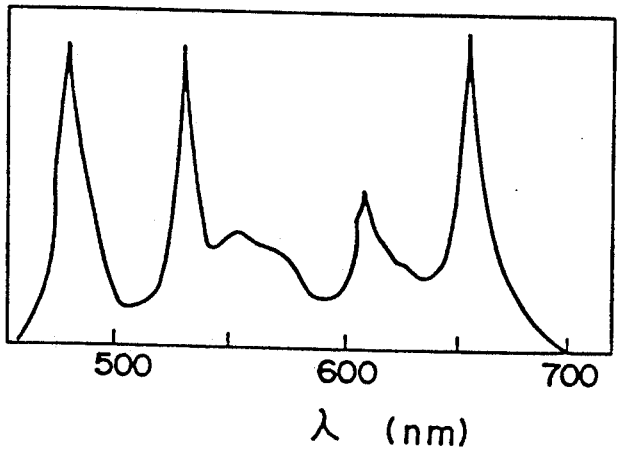

The EL element section 1 includes on a glass substrate 3, a transparent electrode 4 of indium tin oxide (ITO) disposed so as to form a like number of first stripe lines $l_1, \ldots, l_n$ at predetermined intervals, a first dielectric layer 5 of tantalum pentaoxide ($Ta_2O_5$), a luminous layer 6 having a three-layered structure of a 0.5 um-thick blue luminous layer 6*a* of zinc sulfide (ZnS) containing 0.1% of thulium (Tm) and 0.1% of fluorine (F), a 0.2 um-thick green luminous layer 6*b* of zinc sulfide containing about 1% of erbium (Er) and about 1% of fluorine, and an about 0.2 um-thick red luminous layer 6*c* of zinc sulfide containing about 1% of samarium (Sm) and about 1% of fluorine, a second dielectric layer 7 of tantalum pentaoxide, and a rear electrode 8 of an aluminum (Al) layer including a plurality of second stripe lines $v_1, \ldots, V_n$ disposed orthogonal to the first stripe lines $l_1, \ldots, l_n$ such that by applying a voltage corresponding to image information across any particular one of the stripe lines of the transparent electrode 4 and any particular one of the stripe lines of the rear electrode 8, the luminous layer portion located at the intersection of those particular stripe lines is caused to emit light. The principle of luminescence is as shown in FIG. 2(*a*) and thus rays of light having respective wavelengths are emitted. FIG. 2(*b*) shows the emission spectrum of the rays of light emitted from this luminous layer. One of the intersections constitutes a cell here.

The color filter section 2 is disposed on the glass baseplate side of the EL element section and includes a repeat of a red transparent filter R, a green transparent filter G and a blue transparent filter B arranged in order, each filter including a dyeable polymer layer and corresponding to a respective cell C, as shown in plan view in FIG. 1(*b*).

Figure 3:
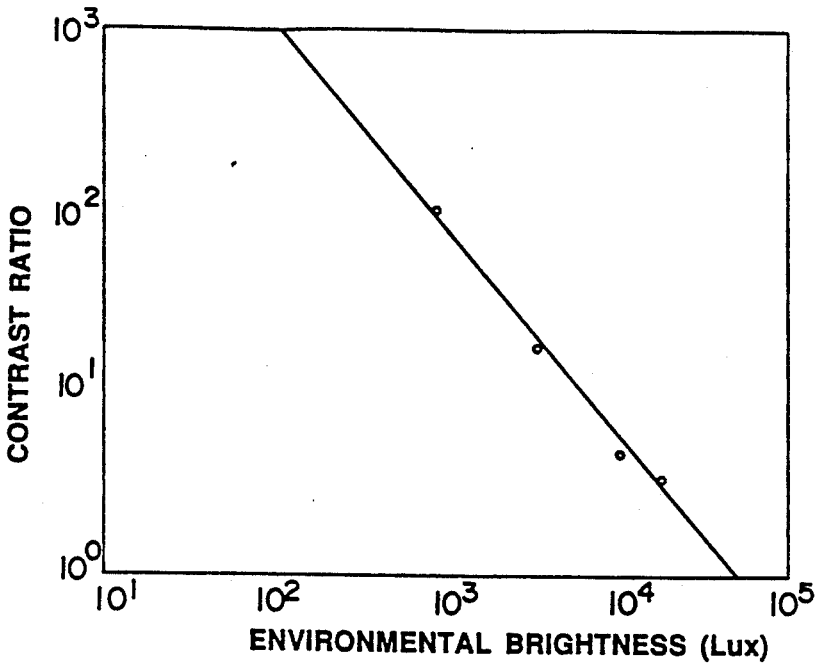
FIG. 3 is diagram showing a contrast ratio in the apparatus.

The contrast characteristic of this color display apparatus is shown in FIG. 3. As will be clear from FIG. 3, the contrast ratio is about 1:100 for less than 1000 1x, so that the characteristic is extremely satisfactory and greatly improved compared to the conventional one with a ratio of 1:10.

Figure 4:
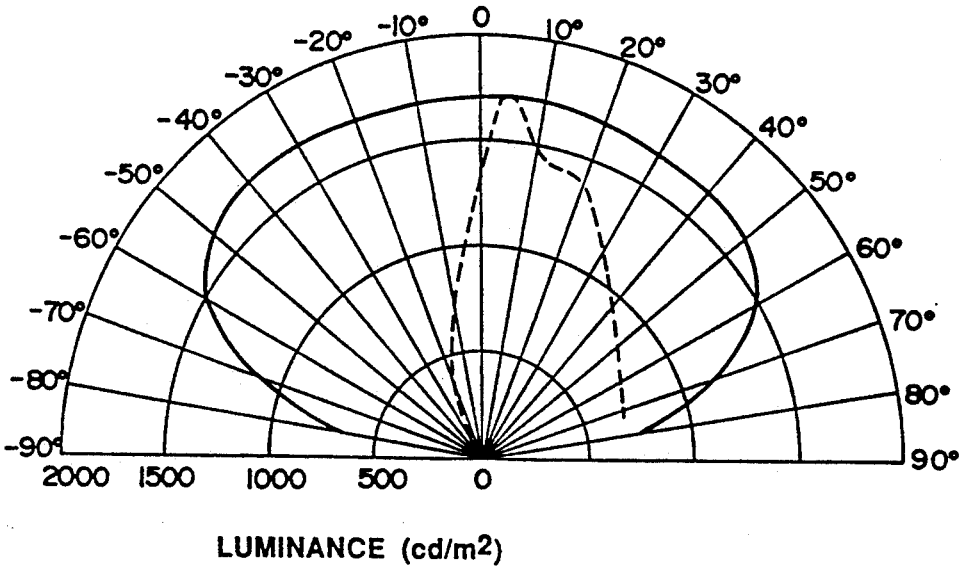
FIG. 4 is a diagram showing the comparison and angle of visual field between the inventive apparatus and a conventional apparatus.

FIG. 4 shows a visual angle-dependent luminace characteristic. The color display apparatus according to the present invention is shown by the solid line, which exhibits that the luminance does not lower up to more than 60 degrees. It is understood that the inventive apparatus is of high visual angle compared to the conventional apparatus shown by the broken lines.

This display apparatus does not need backlight and is very thin, i.e., at most about 1 mm thick, even inclusive of the glass baseplate.

While in the particular example the respective cells are formed integrally, the luminous layer as well as the respective layers may be provided separately for each cell. This applies to the electrodes.

Figure 5:
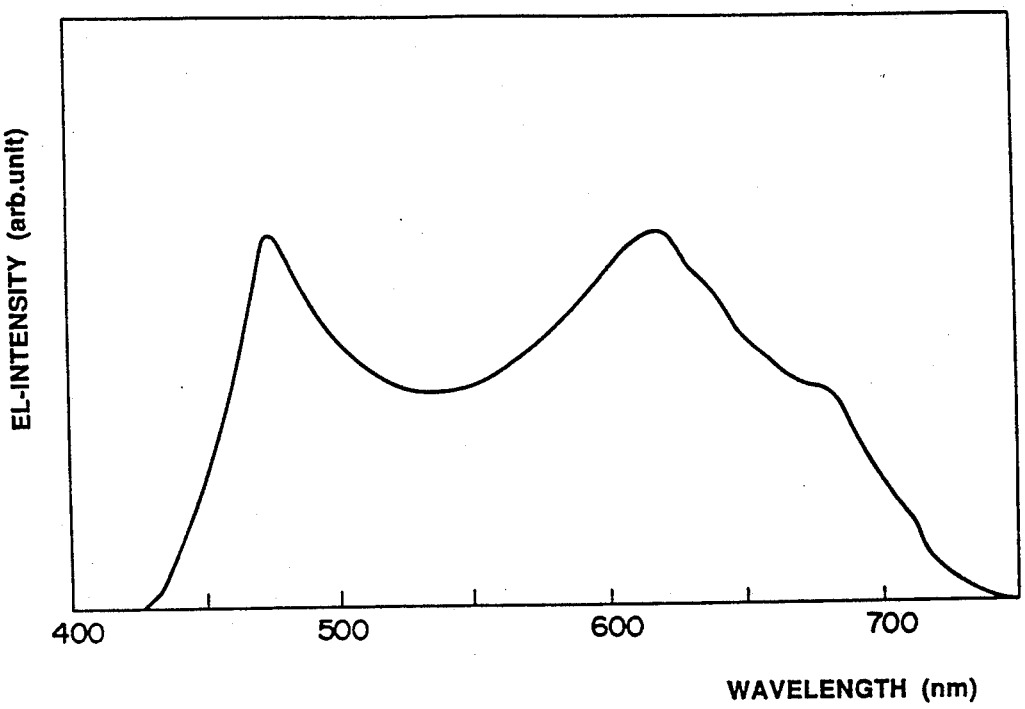
FIG. 5 illustrates the emission spectrum of light from a luminous layer of another example of the present invention.

The luminous layer must not have a three-layered structure. For example, if the luminous layer is made of zinc sulfide containing nitrogen (N); strontium sulfide (SrS) containing cerium (Ce), europium (Eu) and potassium (K); CaSrS containing cerium (Ce), europium (Eu) and potassium (K); BaSe; ZnS; ZnCdS; $ZnF_2$; $SrTiO_3$; or $BaTiO_3$, a single such layer can emit white light. FIG. 5 shows the emission spectrum of SrS containing Ce, Eu and K. The contents of impurities which are the luminescent center of each luminous layer in the example 1 are not limited to 1% and may be changed as needed within a range of 0.1–5%. The kind of impurities used may be changed as needed.

For the color filter section, a dyeable polymer layer directly coated on the glass baseplate may be used as in the particular example. Alternatively, color filters formed separately may be attached, namely, a different color filter structure may be used as needed.

A protective film or the like may be provided as needed.

EXAMPLE 2

Another example of the thin-film EL elements used in the color display apparatus will be now described.

Figure 6:
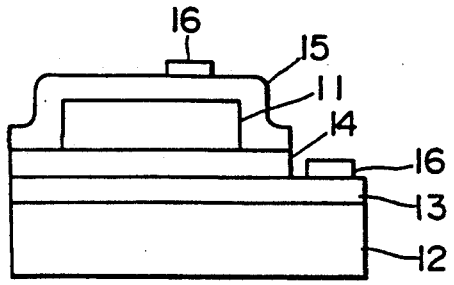
FIG. 6 illustrates the structure of a thin-film EL element as a second example of the present invention.

The thin-film EL element includes a single luminous layer which can emit light. As shown in FIG. 6, a luminous layer 11 of thin-film EL elements having a double dielectric structure is composed of a 5000 A-thick thin-film layer of zinc sulphide containing nitrogen.

It is formed by laminating in order on a transparent glass baseplate 12, a transparent electrode 13 of a tin oxide ($SnO_2$) layer, etc., a first dielectric layer 14, a luminous layer 11 of zinc sulphide containing nitrogen as mentioned above, a second dielectric layer 15, and a rear electrode 16 of a thin aluminum (A1) film.

For the formation of the luminous layer, a process is employed in which a zinc sulphide layer is formed by sputtering and nitrogen is then implanted in the zinc sulphide layer by ion implantation.

Figure 7:
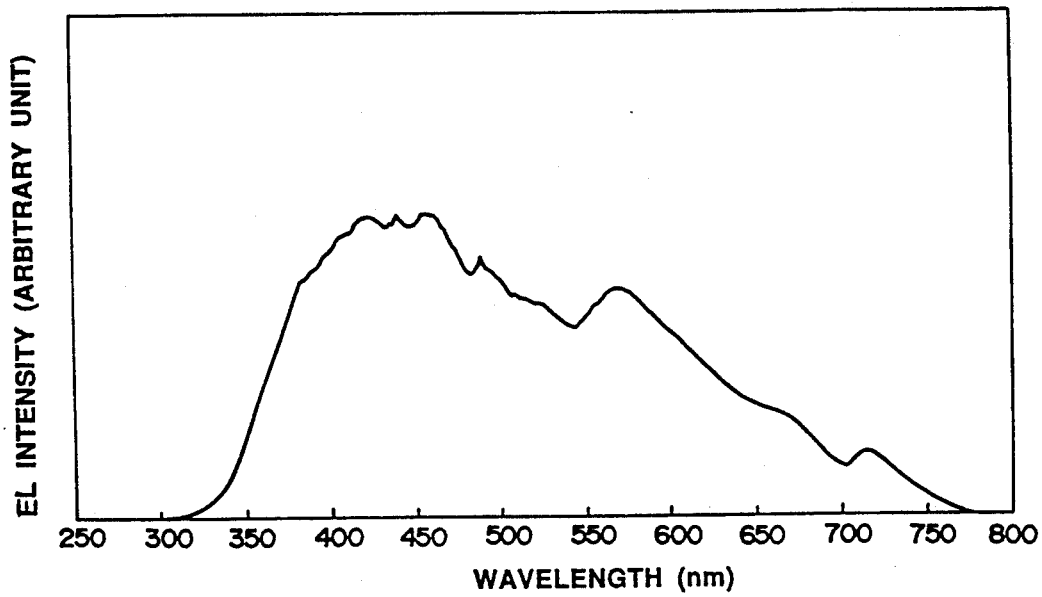
FIG. 7 is a diagram showing the emission spectrum on the thin-film EL element of the embodiment of FIG. 6.

The emission spectrum of the luminescence obtained by applying an alternate electric field across the thin-film EL element has a wide range of luminescent wavelengths covering three primary colors as shown in FIG. 7.

As just described above, according to the thin-film EL element, true white light is provided and a full-color display panel can be fabricated.

While for the formation of the luminous layer the process including the implantation of nitrogen ions after the formation of the zinc sulfide film has been used, the present invention is not limited to this process. A process for forming the luminous layer by sputtering or CVD in an atmosphere of nitrogen may be used. Namely, it may be selected as needed.

EXAMPLE 3

A further example of the thin-film EL element used in the color display apparatus will be described.

Figure 8:
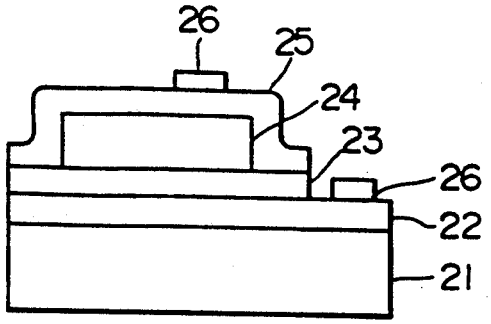
FIG. 8 illustrates a thin-film EL element of a third example of the present invention.

As shown in FIG. 8, the thin-film EL element has a double dielectric layer structure which includes on a transparent glass baseplate 21 a transparent electrode 22 of tin oxide layer ($SnO_2$), etc., a first dielectric layer 23, a luminous layer 24 of ZnS: Mn, a black dielectric layer 25 of tantalum oxide ($TaO_x$ where $x < 2.5$) and a rear electrode 26 of a thin aluminum (A1) film laminated in order.

Figure 9:
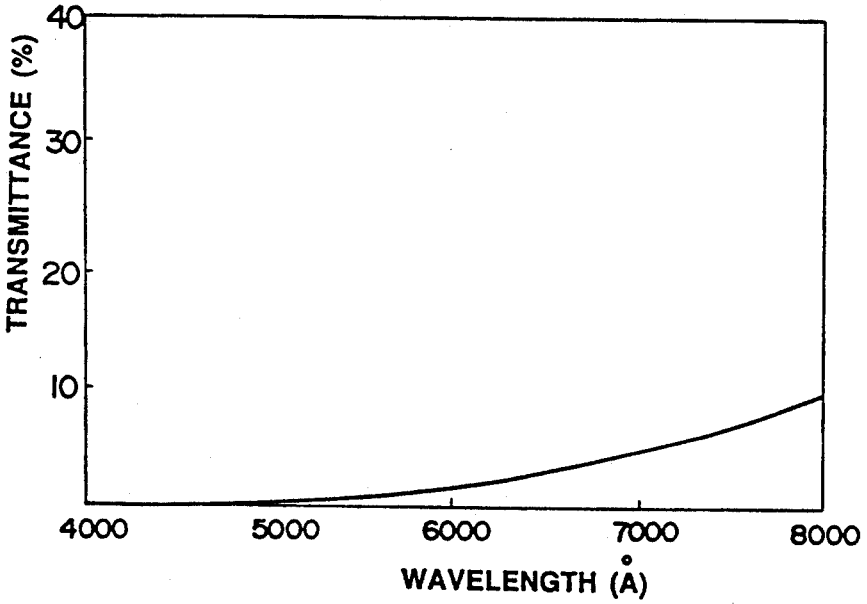
FIG. 9 illustrates the transmittance of a second dielectric layer used in the EL element of FIG. 8.

The second dielectric layer has the relationship between wavelength and transmittance as shown in FIG. 9, which shows that the transmittance is less than 10% in a visual light area.

Figure 10:
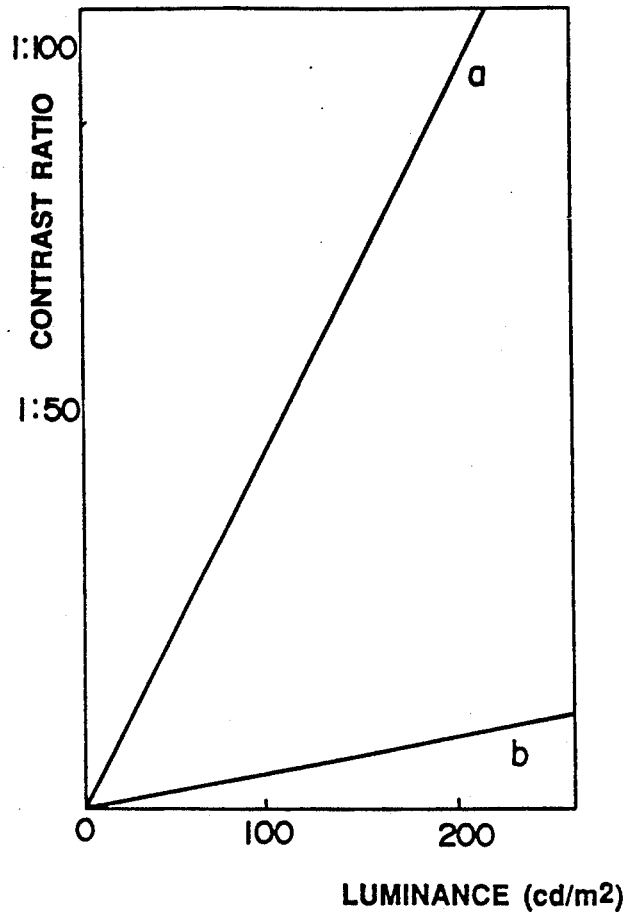
FIG. 10 is a diagram illustrating the comparison and contrast ratio between the thin-film EL elements of the third example of the present invention and using a conventional insulating film.

A curve a in FIG. 10 shows the relationship between luminance and contrast ratio of the thin-film element ($cd/m^2$).

For comparison purposes, a curve b in FIG. 10 shows the relationship between luminance ($cd/m^2$) and contrast ratio of a conventional thin-film EL element using tantalum pentaoxide ($Ta_2O_5$) as a material constituting the second dielectric layer.

It will be clear from these comparison that in order to obtain a contrast ratio of 1:100 at an illumination of 1000 1×, the conventional thin-film EL element requires a luminance of 200 $cd/m^2$ while the inventive element only requires 20 $cd/m^2$, which illustrates that the contrast is greatly improved.

The black tantalum oxide film can be easily obtained by only changing partial conditions of a process for forming a transparent tantalum pentaoxide layer used conventionally—for example, by lowering only the partial pressure of oxygen under the same conditions as those in the sputtering process. Thus, the manufacturing work is performed efficiently.

Figure 11:
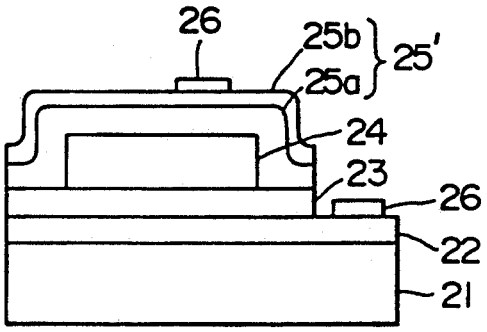
FIG. 11 illustrates a thin-film EL element having another structure using the insulating film of the EL element of FIG. 8.

While in the particular example the black tantalum oxide film is used instead of the conventional transparent tantalum pentaoxide film, a composite film 25' of a black tantalum oxide layer **25*a* and a different dielectric layer 25*b* may be formed as the second dielectric layer as shown in FIG. 11**. It may be applicable to other oxides and nitrides such as yttrium oxides, silicon oxides, silicon nitrides, etc., as in a thin-film transistor.

The materials constituting the luminous layer, transparent electrode and rear electrode are not limited to those of the particular example, and other materials are effective, of course.

The tantalum oxide film may be selected as needed among ones having transmittance of 30% or less in a visual area. If a film having a transmittance of more than 30% is used, it would reduce the contrast ratio.

The relationship between partial pressure of oxygen and transmittance is also ascertained from experiments such as those shown below.

A $TaO_x$ film was formed on a glass baseplate by using $Ta_2O_5$ as the target and changing the partial pressure of oxygen in a high frequency (RF) sputtering process.

Figure 12:
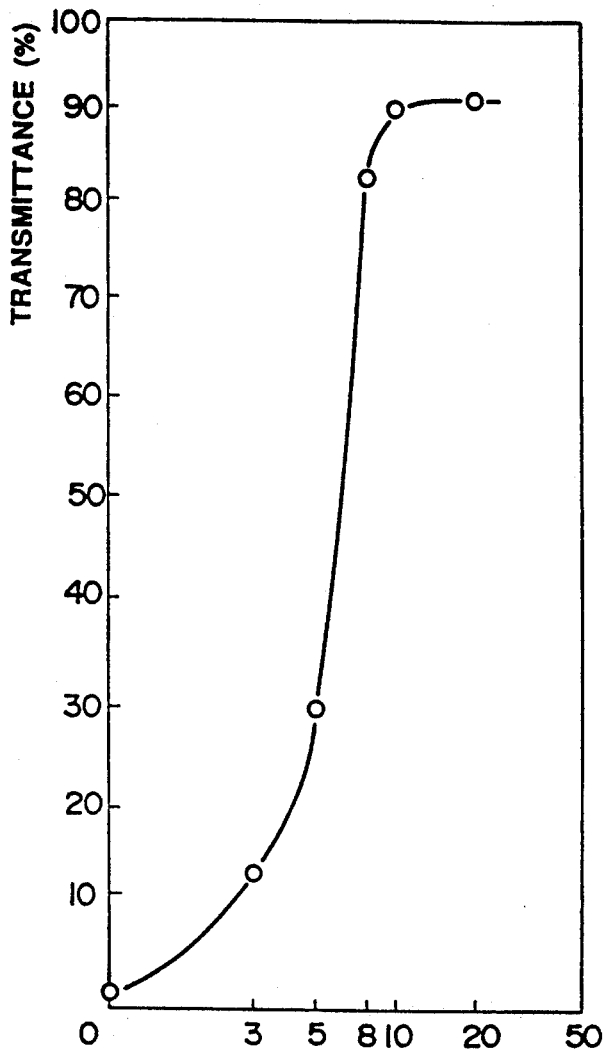
FIG. 12 is a diagram illustrating the relationship between the partial pressure of oxygen and transmittance in the formation of an insulating layer of the element of FIG. 11.

FIG. 12 shows the results of measurement of the relationship between the partial pressure of oxygen at the film formation and transmittance of the formed $TaO_x$ film when the partial pressure of argon (Ar) was $5\times10^{-3}$ (Torr). (In FIG. 12, the axis of abscessas represents the partial pressure of oxygen $\times10^{-5}$ (Torr) and the axis of ordinates the transmittance (%).)

It will be clear from FIG. 12 that by reducing the partial pressure of oxygen and the proportion in composition of oxygen the transmittance is reduced. The transmittance of the $TaO_x$ film formed at the partial pressure of oxygen=0 was about 2%.

According to the present invention, the proportion in composition of oxygen or nitrogen in insulating oxides or nitrides is reduced stoichiometrically, so that the manufacturing process is not substantially changed and a black insulating film can be very easily provided.

EXAMPLE 4

Another example of the thin-film EL element used in the color display apparatus will be described.

Figure 13:
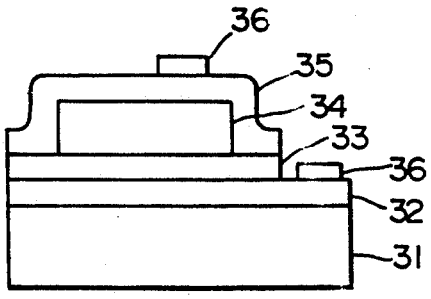
FIG. 13 illustrates a thin-film EL element as a fourth example of the present invention.

FIG. 13 shows a thin-film EL element as an example of the present invention.

The EL element includes on a transparent glass baseplate 31 a transparent electrode 32 of tin oxide ($SiO_2$) layer, etc., a first dielectric layer 33 of yttrium oxide ($Y_2O_3$), a luminous layer 34 of zinc sulphide (ZnS): manganese (Mn), a second dielectric layer 35 the proportion in composition of which continuously changes from black to transparent, and a rear electrode 36 of an aluminum layer, laminated in order.

The second dielectric layer has a proportion in composition continuously changing stoichiometrically from a black tantalum oxide film ($TaO_x$ where $x<2.5$) 3000 Å thick to a transparent tantalum pentaoxide ($Ta_2O_5$) film and has a thickness of 5000 Å in total.

The second dielectric layer is formed by RF sputtering. Tantalum pentaoxide is used as the target. Initially, a tantalum oxide ($TaO_x$ where $x<2.5$) film 3000 Å thick is deposited under reduced partial pressure of oxygen, and the partial pressure of oxygen is then gradually increased to thereby deposit continuously a tantalum oxide ($TaO_{x'}$ where $x'=x-2.5$) film 2000 Å thick.

Figure 14:
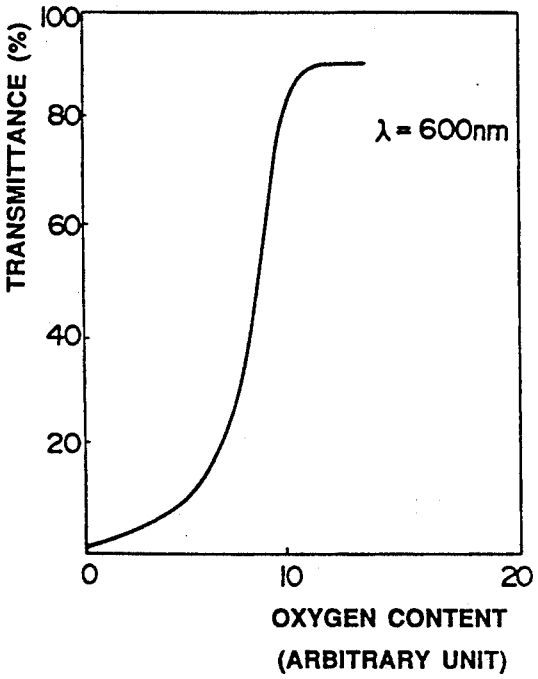
FIG. 14(*a*) is a graph showing the relationship between oxygen content and transmittance in the formation of a tantalum oxide film.
Figure 14:
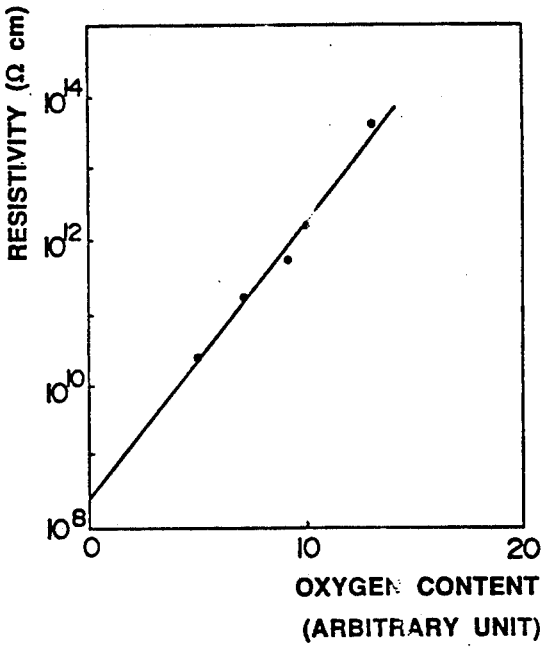

FIG. 14(*a*) and FIG. 14(*b*) show the relationship between oxide content of a tantalum oxide film and its transmittance (%) to light having a wavelength $\lambda=600$ nm and the relationship between oxygen content and resistivity (Ω cm), respectively, when the tantalum oxide film is formed using tantalum pentaoxide as the target by RF sputtering and when the oxygen content is changed. As will be clear from these Figures, as the oxygen content decreases, the transmittance as well as resistivity is reduced whereas as the oxygen content increases, the resistivity also increases.

Figure 15:
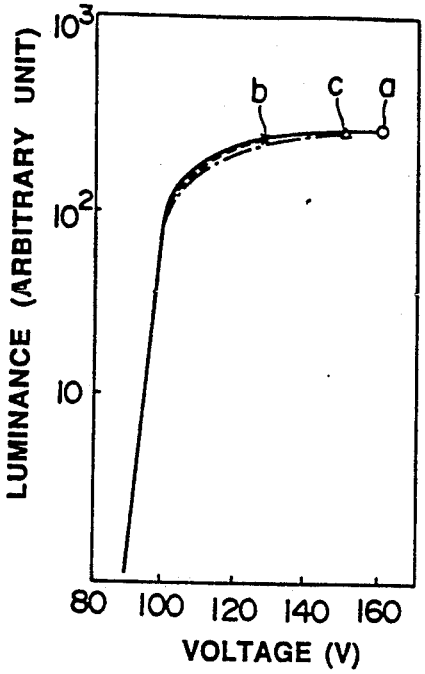
FIG. 15 is a diagram illustrating the comparison in voltage-luminance characteristic between the thin-film EL elements of a fourth example of the present invention and a conventional film.

A curve a in FIG. 15 shows the luminance-voltage characteristic of the thin-film EL element thus formed. For comparison purposes, curves b and c in FIG. 15 show the luminance-voltage characteristics of a thin-film EL element having the same structure as the example 4 except for the second dielectric layer which consists of a single (black) tantalum oxide ($TaO_x$ where $x<2.5$) film 5000 Å thick and another thin-film EL element having the same structure as the example 4 except for the second dielectric layer having a two-layered structure which consists of a black tantalum oxide ($TaO_x$ where $x<2.5$) film 4000 Å thick and a transparent tantalum pentaoxide film ($Ta_2O_5$) 1000 Å thick. The elements a and b are substantially equal in contrast and the element c is somewhat lower. (In FIG. 15, the axis of ordinates represents luminance and the axis of abscessas applied voltage.) It will be understood that the voltages which the elements can withstand for a long time (dielectric strength) are 165 V for a, 125 V for b and 150 V for c and that the thin-film EL element of the inventive example in which the second dielectric layer is continuously changed has a greatly improved dielectric strength.

As just described above, the thin-film EL element according to the inventive examples exhibits high contrast and high breakdown voltage.

It is to be noted that the ratio in film thickness of the black layer, continuous layer and transparent layer of the second dielectric layer is not limited to the particular examples and may be changed as needed.

The materials of the other respective layers are not limited to the particular examples and may be changed as needed. In addition, the inventive thin-film EL elements may be used as a light source for writing signals into, reading signals out of and erasing signals in a recording medium for illuminating purposes in addition to the display apparatus applications.

Figure 16:
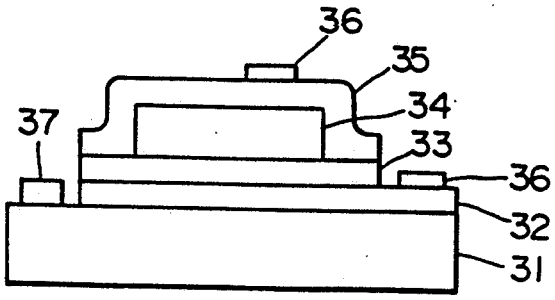
FIG. 16 illustrates a modification of the example of FIG. 15.

With thin-film EL elements used in an display apparatus under environmental conditions in which the environmental brightness changes, there is the problem that contrast is lowered and the display becomes difficult to view when the environmental brightness-illumination increases whereas the display is excessively bright if the luminance is constant when the illumination is extremely low. In order to cope with this problem, for example as shown in FIG. 16, a photosensor 37 may be provided. The voltage applied to the thin-film EL element is controlled in accordance with a signal from the photosensor to change the luminance to thereby maintain the contrast constant and improve the display effect.

Figure 17:
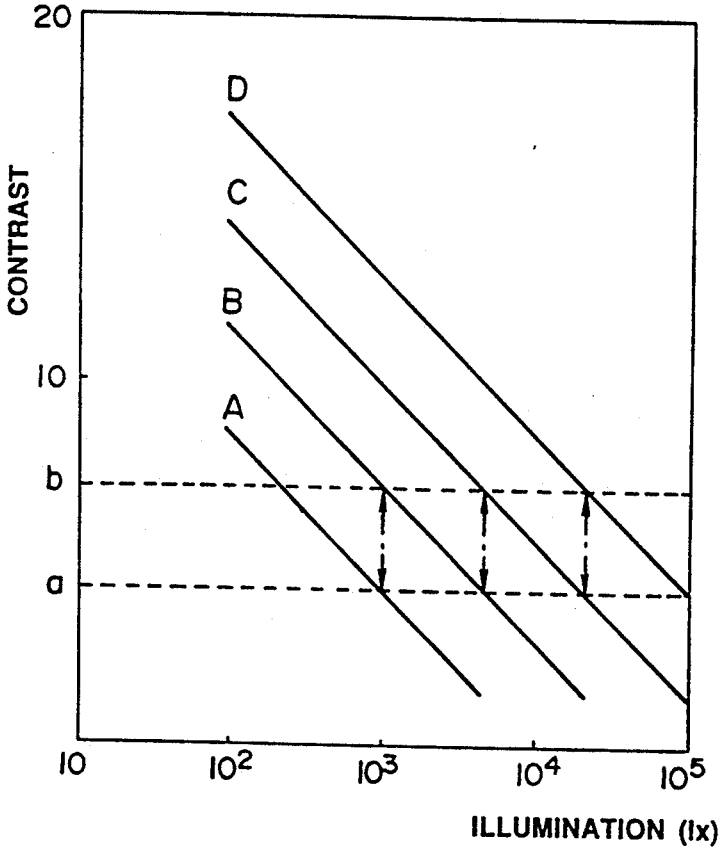
FIG. 17 is a diagram showing curves on control of the luminance for the environmental illumination (axis of abscissas) to maintain within a predetermined range the contrast of the thin-film EL element of FIG. 16.
Figure 18:
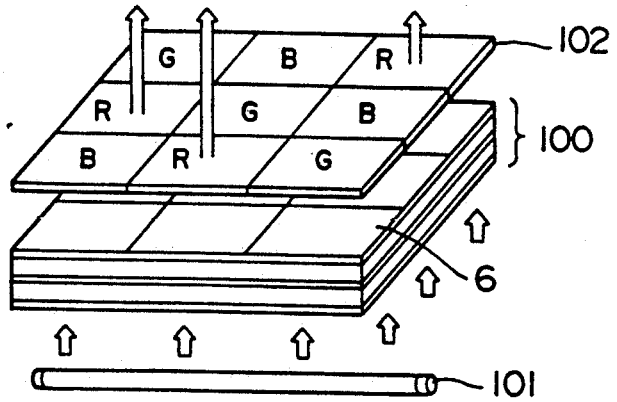
FIG.18 PRIOR ART
FIG. 18 illustrates a conventional prior art color display apparatus.
Figure 19:
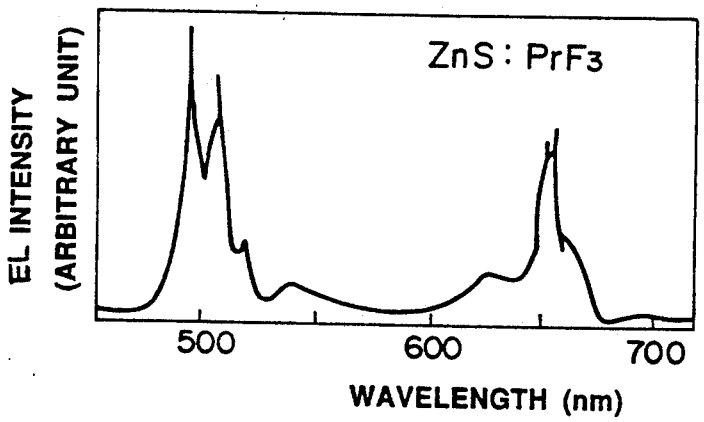
FIG.19 PRIOR ART
FIG. 19 illustrates the emission spectrum of a conventional thin-film EL element which emits white light.

As shown in FIG. 17, control of the applied voltage is easy if it is provided so as to change the applied voltage stepwise to thereby maintain the contrast within a predetermined range (a–b) when the signal from the photosensor exceeds a predetermined value.

For example, assume that the thin-film EL element is emitting light at a certain luminance of A. The luminance is changed stepwise as shown by A, B, C, D. If the environmental illumination or the detection output from the photosensor 7 becomes 1000 1×, the applied voltage is increased such that the luminance becomes B; if the illumination further increases to about 5000 1×, the luminance changes to C and so on. In this way, the contrast can be maintained within a substantially constant range without being influenced by the environmental illuminations.

The applied voltage may be changed continuously in accordance with the detection output from the photosensor.

We claim:

1. A color display apparatus comprising:

an EL element section including a plurality of arranged cells, each cell including a thin-film EL element having a luminous layer including a zinc sulphide containing only nitrogen as an activator so as to emit white light;

a color filter section including a plurality of predetermined color filters corresponding to the cells and disposed on the surface of the EL element section;

respective voltages applied to the thin-film EL elements being controlled in accordance with image information for color display; and the luminous layer of each cell in the EL element section is a single white luminous layer.

2. A color display apparatus according to claim 1 characterized in that the respective thin-film EL elements are arranged on the same glass baseplate, and each thin-film EL element has a double dielectric structure in which a transparent electrode, a first dielectric layer, a luminous layer, a second dielectric layer and a rear electrode are laminated in order.

3. A color display apparatus according to claim 2 characterized in that each of the cells of the EL element section includes the first dielectric layer, luminous layer and second dielectric layer formed integrally, and that the transparent electrode and rear electrode include a plurality of stripe lines arranged at predetermined intervals, the stripe lines of the transparent electrodes are orthogonal to those of the rear electrode, and the intersections of the orthogonal stripe lines are adapted to emit light.

4. A color display apparatus according to claim 1 characterized in that the color filter section includes a dyeable polymer layer dyed by respective colors.

* * * * *